US010986979B2

(12) United States Patent
Sullivan et al.

(10) Patent No.: US 10,986,979 B2
(45) Date of Patent: Apr. 27, 2021

(54) SCRUB SPONGE WITH SELECTIVELY ACCESSIBLE ABRASIVE REGION

(71) Applicants: Scott Sullivan, San Francisco, CA (US); Phillip Lucas Williams, Glendale, CA (US)

(72) Inventors: Scott Sullivan, San Francisco, CA (US); Phillip Lucas Williams, Glendale, CA (US)

( * ) Notice: Subject to any disclaimer, the term of this patent is extended or adjusted under 35 U.S.C. 154(b) by 357 days.

(21) Appl. No.: 15/972,144

(22) Filed: May 5, 2018

(65) Prior Publication Data

US 2019/0046005 A1 Feb. 14, 2019

Related U.S. Application Data

(60) Provisional application No. 62/542,297, filed on Aug. 8, 2017.

(51) Int. Cl.
*A47L 17/08* (2006.01)
*A47L 13/16* (2006.01)

(52) U.S. Cl.
CPC ..... *A47L 17/08* (2013.01); *A47L 13/16* (2013.01)

(58) Field of Classification Search
CPC ..... A47L 17/08; A47L 13/16; B24D 15/00
See application file for complete search history.

(56) References Cited

U.S. PATENT DOCUMENTS 4,484,419 A * 11/1984 Freerks ..... B24D 15/04 451/450
5,392,482 A * 2/1995 Drulias ..... A46B 5/04 15/104.94
2007/0054609 A1* 3/2007 Hackett ..... B24B 7/182 451/523

* cited by examiner

*Primary Examiner* — Michael D Jennings

(57) ABSTRACT

The present invention is a new type of scrub sponge which includes a soft sponge portion and an abrasive pad. According to one embodiment of the invention, the abrasive pad is bonded to the sponge in a recess formed in the sponge so that during normal use, only the surface of the soft sponge will contact the surface of the item being cleaned. Should, during cleaning, the user require a more aggressive scrubbing action, the user may press into the upper side of the soft sponge on an upper side to force the abrasive pad out from its protective recess on the opposing side. The now protruding abrasive pad will contact the surface of the item being cleaned. The action of pushing out the abrasive pad is intuitive to the user since the user will typically push hard on any cleaning implement when they need more aggressive scrubbing action. With the present invention, as the user pushes hard, the more abrasive pad will reveal itself and offer its scrubbing texture to help in the cleaning process.

7 Claims, 15 Drawing Sheets

SCRUB SPONGE WITH SELECTIVELY ACCESSIBLE ABRASIVE REGION

CLAIM OF PRIORITY

This application claims priority from U.S. Provisional Patent Application No. 62/542,297, filed Aug. 8, 2017, entitled: "Scrub Sponge with Selectively Accessible Abrasive Region," the contents of which are incorporated herein in their entirety.

BACKGROUND OF THE INVENTION a) Field of the Invention

The present invention relates to scrub sponge, and more particularly, to such scrub sponges which provide scrubbing surfaces of different levels of abrasion.

b) Description of the Related Art

The use of low density abrasive pads for cleaning and scouring, dishes, pots and pans is well known. These pads are typically nonwoven lofty open mats formed from randomly disposed fibers. The fibers are typically bonded together at points of fiber contact using a binder containing an abrasive, such as aluminum oxide (alumina), silicon carbide, or silica. Other softer abrasives include calcium carbonate, talc, and synthetic resins. The abrasive character of the non-woven fibers can be controlled by the amount, nature and depth of penetration of the abrasives being applied to the fiber pad.

These abrasive pads may be used alone, or in combination with a softer sponge-like substrate wherein a user may flip the sponge between a softer cleaning side and a more abrasive side, as needed during cleaning.

One successful commercial product using this pad construction is sold under the trade name "Scotchbrite" by the 3M Company of Saint Paul, Minn.

The 3M Company also makes a scrub sponge which includes a relatively soft, water absorbent porous material, such as natural or synthetic sponge, to which is laminated or attached on one surface thereof, a scrim which can contain an abrasive material, such as the abrasive pad described above. In this instance, the sponge substrate is made from cellulose fibers which are treated and formed into a water absorbent sponge-like material and cut into an appropriately sized block shape that is comfortable for a user to hold in his or her hand. The sponge portion of the product provides the user with an effective washing surface which is well suited to hold water and soap and wipe away loose food and grime from pots and pans. In contrast, when flipped over, the abrasive scrim side provides an aggressive scrubbing surface to help remove more stubborn food-related bits from the surfaces of the pots and pans than a sponge, but which generally does not impart scratches to surfaces.

When washing a pan, for example, using this type of sponge, a user would normally first saturate the sponge with water, then squeeze out some of the water and apply a drop or two of dish-washing soap. He or she would then begin wiping the already wet pan using the soft sponge side of the sponge. The cellulose type sponge is very good at wiping away food debris from the surface of the pan, but does not provide much abrasive cutting action for hardened spots, such as where food debris is "baked on." So, when the user encounters such a tough spot, the user is meant to flip the sponge over so that the more abrasive side contacts the pan surface. Now the user typically pushes into the sponge material, which effectively pushes the more aggressive abrasive side into grinding contact with the stubborn food spot. While pushing into the pan, as the user moves the aggressive sponge surface back and forth over the tough spot, the abrasive layer of the sponge literally grinds apart the hardened food debris causing it to eventually separate from the pan surface.

Although these types of sponges work well, applicants have recognized a potential problem regarding how users may use these conventional sponges. Since the more aggressive side of the sponge works better at removing tough food than the opposing smooth sponge side, a typically user washing dishes may end up using only the aggressive abrasive side, and not flip the sponge from one side to the other, as needed. Unfortunately, by doing this, the abrasive layer will quickly wear out, leaving only the softer sponge side usable. The user will likely discard the sponge when the abrasive surface is no longer effective.

Another potential problem users cleaning pots and pans may experience when they only use the abrasive surface of the sponge is that owing to the rough texture of the abrasive side, the surface of the item being washed may end up less clean (at the microscopic level) than if both sides of the sponge were used. Only the peaks of the rough abrasive side will actually contact the surface being cleaned, which means that the rough surface may leave microscopic streaks of food debris behind on the pan surface. In contrast, the smoother sponge side should provide a more even and thorough clean surface.

It is therefore an object of the present invention to provide a scrub sponge that overcomes the deficiencies of the prior art.

It is another object of the present invention to provide a scrub sponge which includes an abrasive layer which may be selectively deployed for use, only when needed.

SUMMARY OF THE INVENTION

The present invention is a new type of scrub sponge which includes a soft sponge portion and an abrasive pad. According to one embodiment of the invention, the abrasive pad is bonded to the sponge in a recess formed in the sponge so that during normal use, only the surface of the soft sponge will contact the surface of the item being cleaned. Should, during cleaning, the user require a more aggressive scrubbing action, the user may deliberately press into the upper side of the soft sponge on an upper side to force the abrasive pad out from its protective recess on the opposing side. The now protruding abrasive pad will contact the surface of the item being cleaned. Although the pushing is intentional and required to activate the abrasive section, the action of pushing out the abrasive pad is intuitive to the user since the user will typically push hard on any cleaning implement when they need more aggressive scrubbing action.

With the present invention, as the user pushes hard, the more abrasive pad will reveal itself and offer its scrubbing texture to help in the cleaning process.

According to another embodiment of the invention, a sponge includes a lateral groove located along one surface, approximately in the middle of the sponge. Located within this lateral groove is a recessed abrasive pad which remains recessed until the user needs a more aggressive abrasive for cleaning. According to this embodiment, the user users his or her fingers to fold the sponge along the mid-axis so that the bend portion bulges and thereby forces the abrasive pad out from the recess and into an accessible and usable position.

The features of this invention, and the manner of attaining them, will become more apparent and the invention itself will be better understood by reference to the following description of the disclosed embodiments taken in conjunction with the accompanying drawings.

DETAILED DESCRIPTION OF THE PREFERRED EMBODIMENTS

Figure 1:
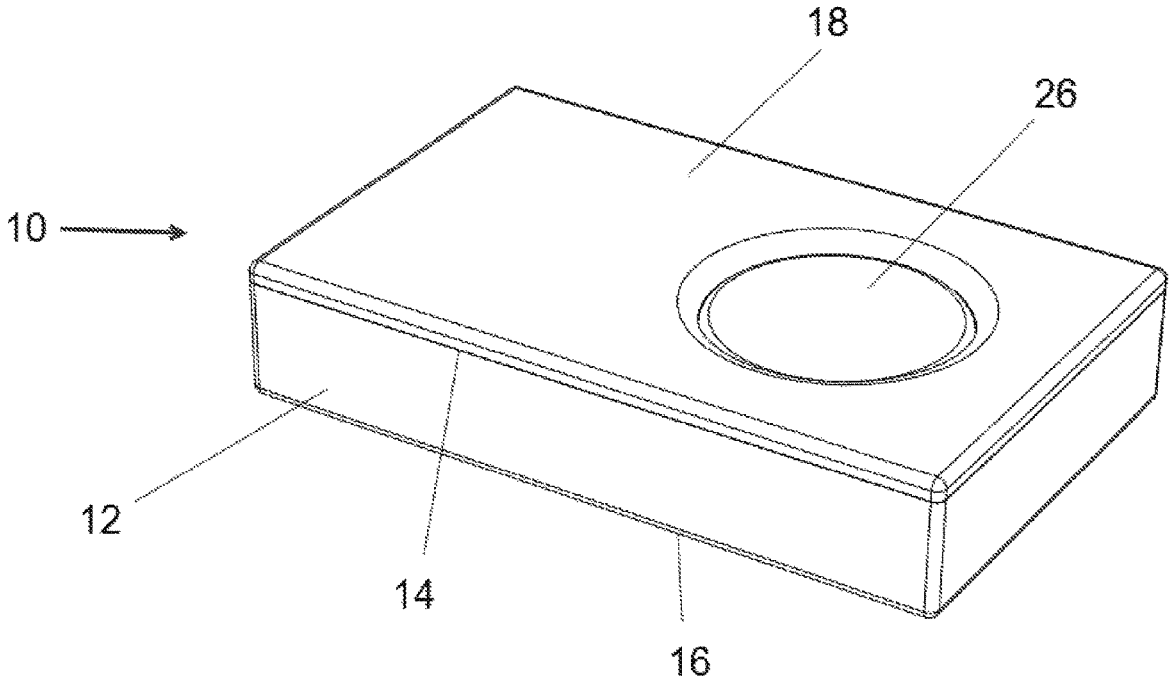
FIG. 1 is an upper perspective view of an exemplary scrub sponge having an abrasive insert, according to a first embodiment of the invention, the insert shown in a retracted position.
Figure 2:
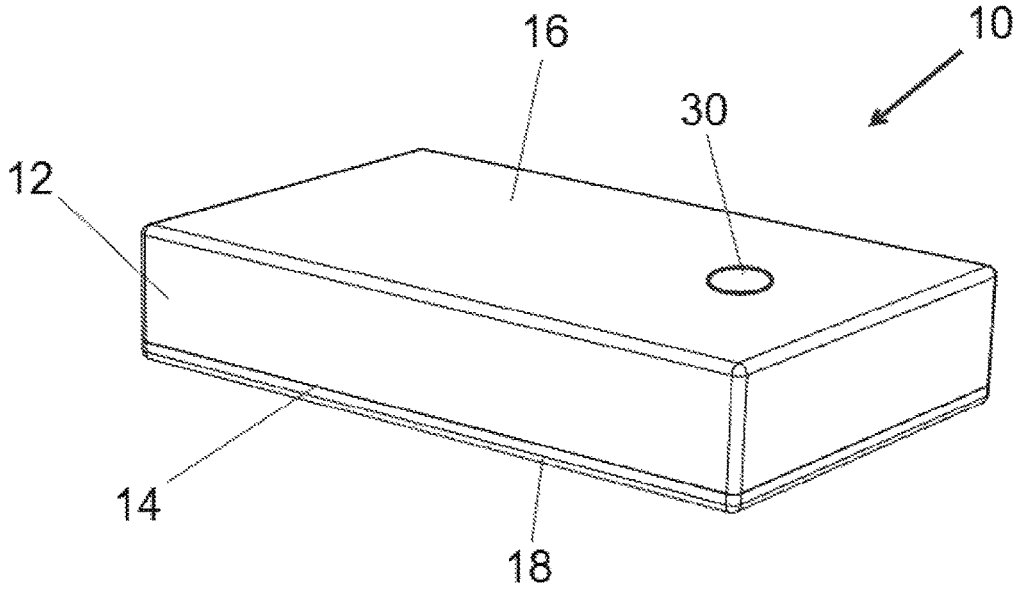
FIG. 2 is a lower perspective view of the scrub sponge of FIG. 1, according to the first embodiment of the invention

By way of overview, the present invention is a new type of scrub sponge which includes a soft sponge portion and an abrasive pad. According to one embodiment of the invention, the abrasive pad is bonded to the sponge within a recess formed in the sponge so that during normal use, only the surface of the soft sponge will contact the surface of the item being cleaned. Should, during cleaning, the user require a more aggressive scrubbing action, the user may press into the upper side of the soft sponge on an upper side to force the abrasive pad out from its protective recess on the opposing side. The now protruding abrasive pad will contact the surface of the item being cleaned. The action of pushing out the abrasive pad is intuitive to the user since a user will typically push hard on any cleaning implement when he or she needs more aggressive scrubbing action. With the present invention, as the user pushes hard, the more abrasive pad will reveal itself and provide its scrubbing texture to help in the cleaning process. When the user stops pushing, the abrasive pad will return back to its rest position within the recess.

According to another embodiment of the invention, a sponge includes a lateral groove located along one surface, approximately in the middle of the sponge. Located within this lateral groove is a recessed abrasive pad which remains recessed until the user needs a more aggressive abrasive for cleaning. According to this embodiment, the user users his or her fingers to fold the sponge along the mid-axis so that the bend portion bulges and thereby forces the abrasive pad out from the recess and into an accessible and usable position.

Referring to FIGS. 1-4, a combination scrub sponge 10 is shown, according to a first embodiment of the invention. Scrub sponge 10 is shown generally box-rectangular in shape to illustrate the invention, however, scrub sponge 10 may take the form of any shape without departing from the gist of the invention, including square, circular, rectangular, triangular, or oval, etc.

According to a first embodiment of the invention, scrub sponge 10 includes a soft sponge portion 12, which may be made from any appropriate material, such as natural sponge, or synthetic sponge, but is preferably made from a cellulose fiber base, which is well known in the art. The steps for conventional manufacture of cellulose sponge material are listed below. Scrub sponge 10, however it is shaped, defines a first surface 14 and a second surface 16. Sponge 10 includes a first level of abrasive texture which provides a first level of cleaning action. The actual level of abrasive texture sponge 10 may be any value, without departing from the present invention, as discussed below.

As shown in FIGS. 1-4, a scrubbing layer 18 having a second level of abrasive action is bonded to first surface 14 of sponge 10. Scrubbing layer 18 is not required for the present invention, but is shown as a useful feature. Scrubbing layer 18 may be bonded to either first surface 14 or second surface 16, or both. Scrubbing layer 18 may be convention, such as being made from a nonwoven lofty open mat formed from randomly disposed fibers, wherein the fibers are bonded together at points of fiber contact using a binder containing an abrasive. The type, size, shape and quantity of the abrasive may vary to control the level and quality of abrasive characteristics. Common types of abrasive materials added to the binder resin include aluminum oxide (alumina), silicon carbide, and silica. Other softer abrasives include calcium carbonate, talc, and synthetic resins. The abrasive character of the non-woven fibers can be controlled by the amount, nature and depth of penetration of the abrasives being applied to the fiber layer. It is preferred, for this invention, that scrubbing layer 18 have more aggressive abrasive characteristics than sponge 10.

According to this first embodiment of the invention, once sponge 10 is cut to size and shape, a recess 20 is created at a select location on first surface 14. The size, shape and depth of recess 20 may vary without departing from the present invention. Recess 20 defines side walls 22 and a bottom surface 24.

Figure 3:
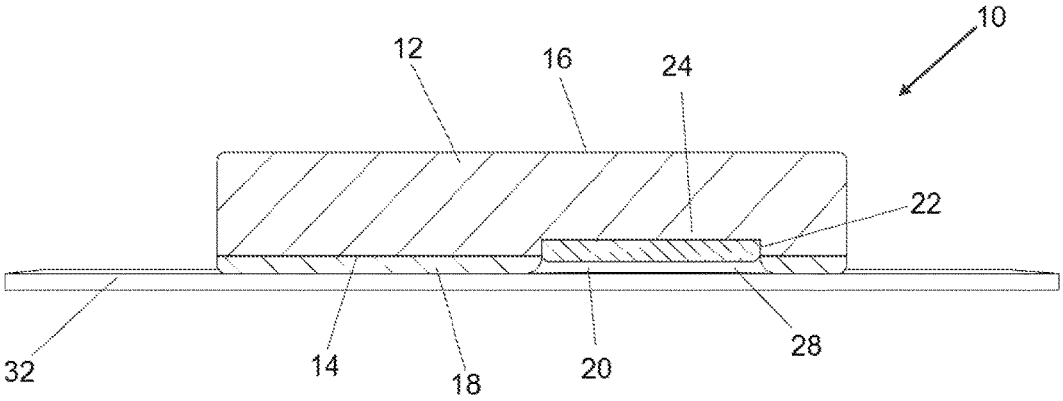
FIG. 3 is a cross-sectional side view of the scrub sponge of FIG. 2, showing the abrasive insert residing above a surface to be cleaned, according to the first embodiment of the invention.
Figure 4:
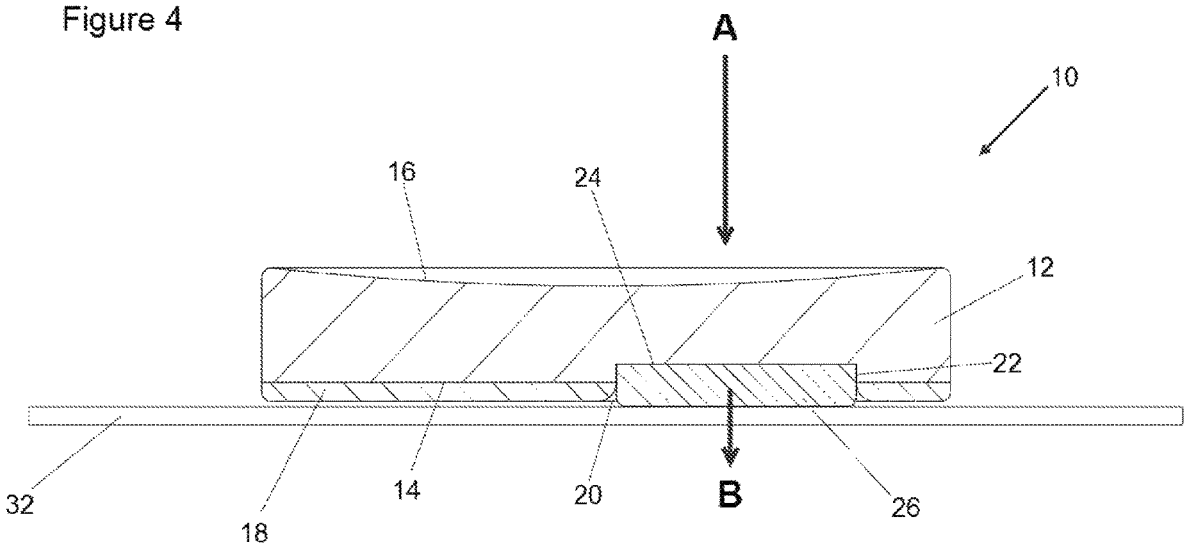
FIG. 4 is a cross-sectional side view of the scrub sponge of FIG. 2, showing the abrasive insert being pressed into an extended and accessible position, engaging the surface to be cleaned, according to the first embodiment of the invention.

As shown in FIGS. 1, 3 and 4, a supplemental abrasive pad 26 is located within recess 20 and bonded to at least bottom surface 24 of the recess using an appropriate adhesive (such as specialized sponge glue made of moisture-cured polyurethane) or bonding technique, depending on the sponge material and the material of the abrasive pad 26. Such adhesives and bonding techniques are well known by those skilled in the art. Supplemental abrasive pad 26 is shaped similar to recess 20 and preferably forms a snug fit, but not so snug that pad 26 cannot be pushed from recess 20 when needed, as described below.

An important aspect of the present invention is that the thickness of supplemental abrasive pad 26 is less than the depth of recess 20, so that pad 26 resides within recess 20 at rest and during normal sponge use. This is shown in FIG. 3 by gap 28 wherein supplemental abrasive pad 26 is located in a retracted position.

In use of this first embodiment of scrub-sponge 10, a user cleaning dishes, pots, pans and the like would use the present sponge as they would any other dish-washing sponge, with applied soap and water. Second surface 16, having a smoother, less abrasive texture would be used for general light cleaning of the surfaces of the dishware and cookware. If the user required additional or stronger scrubbing action, he or she could flip over scrub-sponge 10 so that the more abrasive scrubbing layer 18, located in this structural example on first surface 14.

According to this embodiment of the present invention, if even greater scrubbing action is required, for very stubborn baked-on cooking residues, for example, the user would simply depress second surface 16 of scrub-sponge 10, as illustrated in FIG. 4, in a location indicated by mark 30 (which is located directly opposite the center of supplemental abrasive pad 26). By pushing on second surface 16 at mark 30, supplemental abrasive pad 26 would be forced out of recess 20 to an extended position and into direct scrubbing contact with the pan surface 32 being cleaned. The user can then continue pressing hard and moving the sponge in a swirling, lateral, or back and forth motion, as he or she desires. The harder the user pushes second surface 16, the harder supplemental abrasive pad 26 engages with surface 32 and the more abrasive the scrubbing action will be. When the user releases their pressure on second surface 16 of scrub-sponge 10, supplemental abrasive pad 26 will return back to its retracted position within recess 20, owing to the natural resiliency of sponge 12. Mark 30 may be any appropriate and effective indicator, including a mark made by ink, or a tactile feature, such as a small recess or a small bump or raised ridge.

Figure 5:
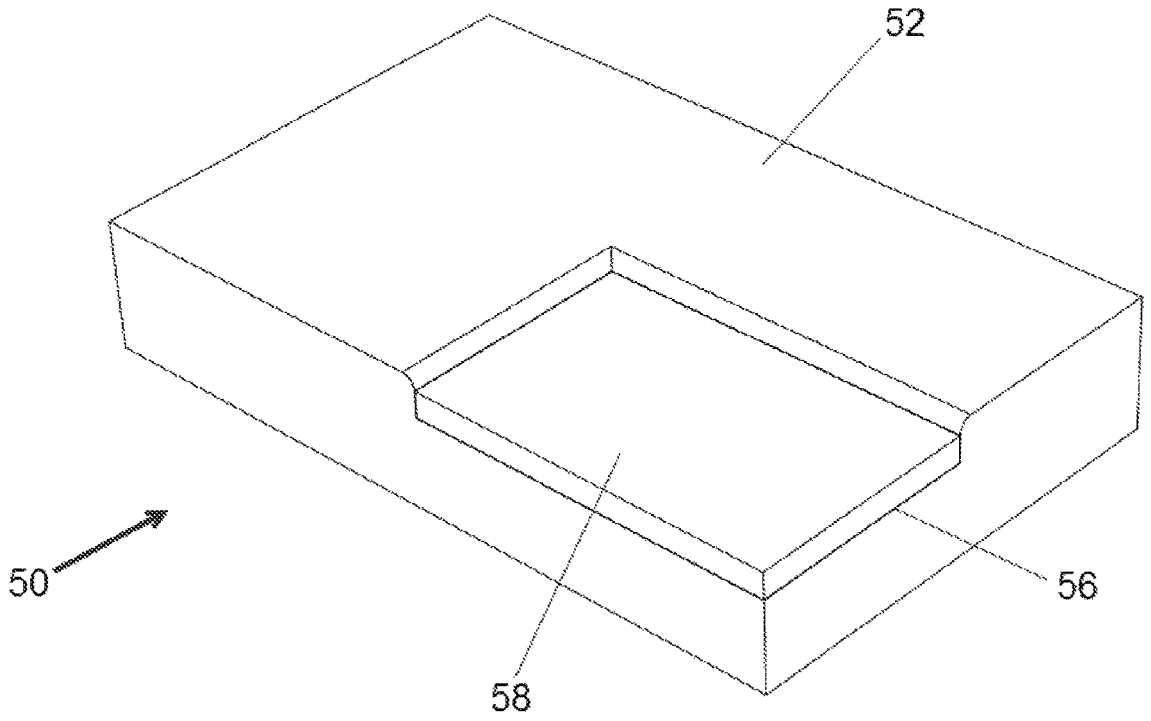
FIG. 5 is an upper perspective view of a scrub sponge, according to a second embodiment of the invention, showing a sponge having an abrasive pad located at a corner of the sponge, and shown in a recessed and inaccessible position.
Figure 6:
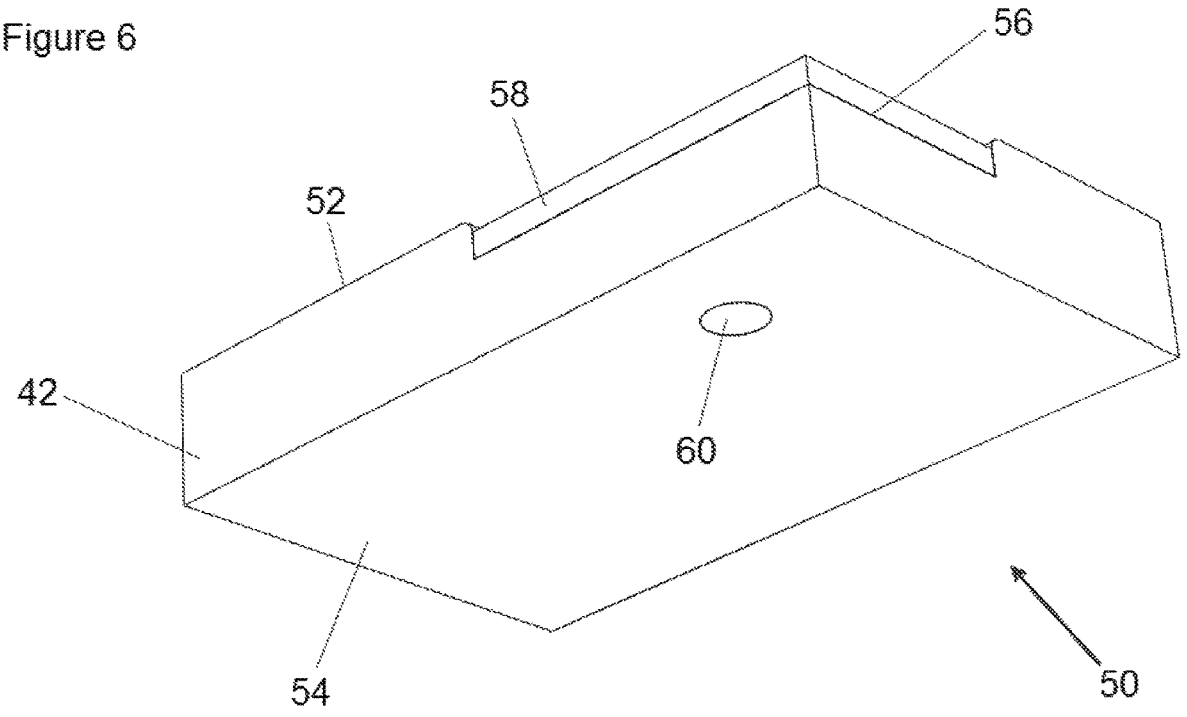
FIG. 6 is a lower perspective view of the scrub sponge of FIG. 5, according to the second embodiment of the invention, showing a locator mark to indicate the location of the abrasive pad.
Figure 7:
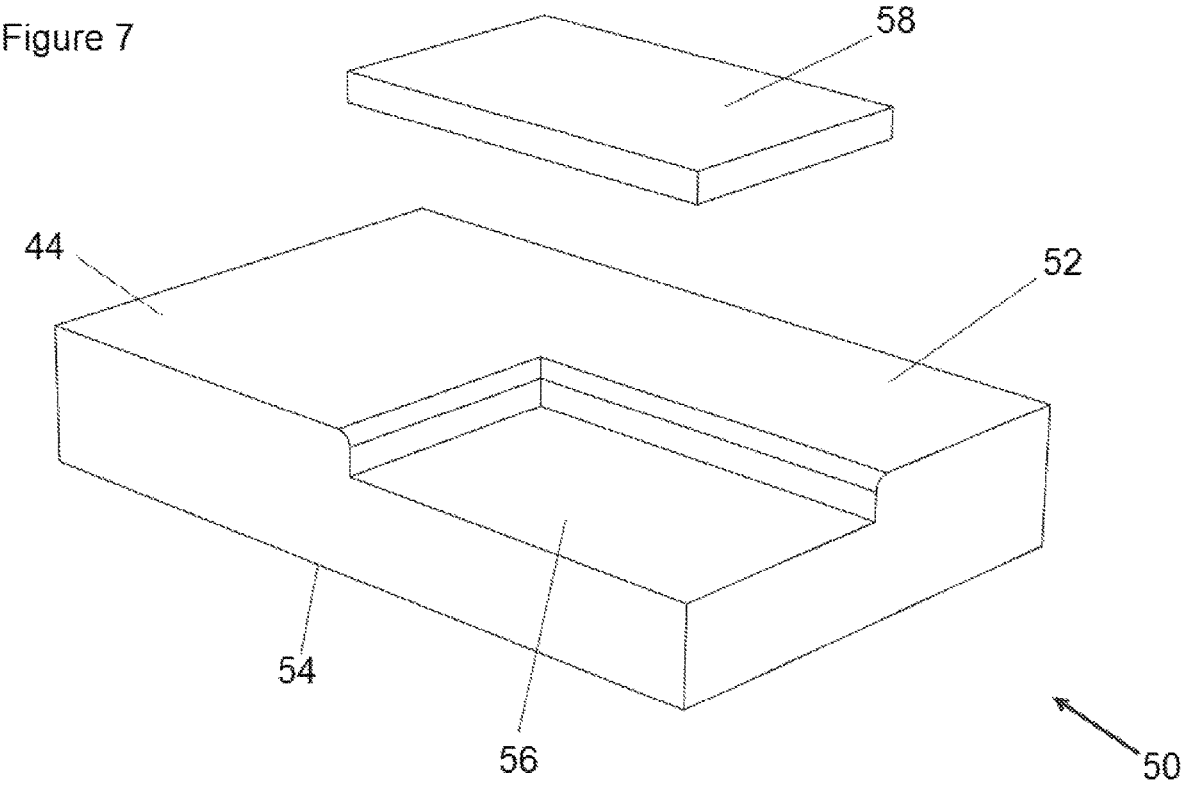
FIG. 7 is an exploded perspective view of the scrub sponge of FIG. 5, showing details of the abrasive insert and a recess formed into the sponge for receiving the abrasive insert, according to the second embodiment of the invention.

Referring now to FIGS. 5, 6, and 7, a second embodiment of the invention is shown. This second embodiment is very similar to the above-described first embodiment shown in FIGS. 1-4, except that circular recess 20 of scrub-sponge 10, shown in FIGS. 1-4, is now rectangular in shape and located at one corner of a rectangular sponge. According to this second embodiment, a rectangular sponge 50 includes a first surface 52 and a second surface 54. A recess 56 is formed in sponge 50 and is positioned at a corner, as shown in FIGS. 5 and 7. Recess 56 is rectangular in this embodiment. Similar to the above-described first embodiment shown in FIGS. 1-4, a supplemental abrasive pad 58 is secured to sponge 50 within recess 56 using an appropriate adhesive or bonding technique. Supplemental abrasive pad 58 is shaped to fit within recess 56, as shown in FIGS. 5 and 7.

According to this second embodiment of the invention, sponge 50 provides a first level of abrasive texture, while supplemental abrasive pad 58 provides a second level of abrasive texture and scrubbing action during cleaning. It is preferred that supplemental abrasive pad 58 provides a more abrasive scrubbing action than that of sponge 50. As before, an important aspect of this second embodiment of the invention, supplemental abrasive pad 58 is thinner than the depth of recess 56 so that supplemental abrasive pad 58 does not contact the surfaces being cleaned during normal use, only when needed.

In use of this second embodiment of sponge 50, a user cleaning dishes, pots, pans and the like would use the present sponge as they would any other dish-washing sponge, with applied soap and water. Either first surface 52, or second surface 54, preferably includes a smoother, less abrasive texture and would therefore be used for general light cleaning of the surfaces of the dishware and cookware. If the user requires additional or stronger scrubbing action, he or she could flip over scrub-sponge 10 over so that first surface 52 (the one with the recess 56), is facing down, contacting the surface being cleaned and depress second surface 54, at a mark 60 (as shown in FIG. 6). This pressing action will force supplemental abrasive pad 58 into scrubbing contact with the surface being cleaned. This arrangement is meaningful because the user may quickly and easily switch between smooth and abrasive surfaces simply by adjusting which side (left or right) of second surface 54 he or she will depress during cleaning.

Figure 8:
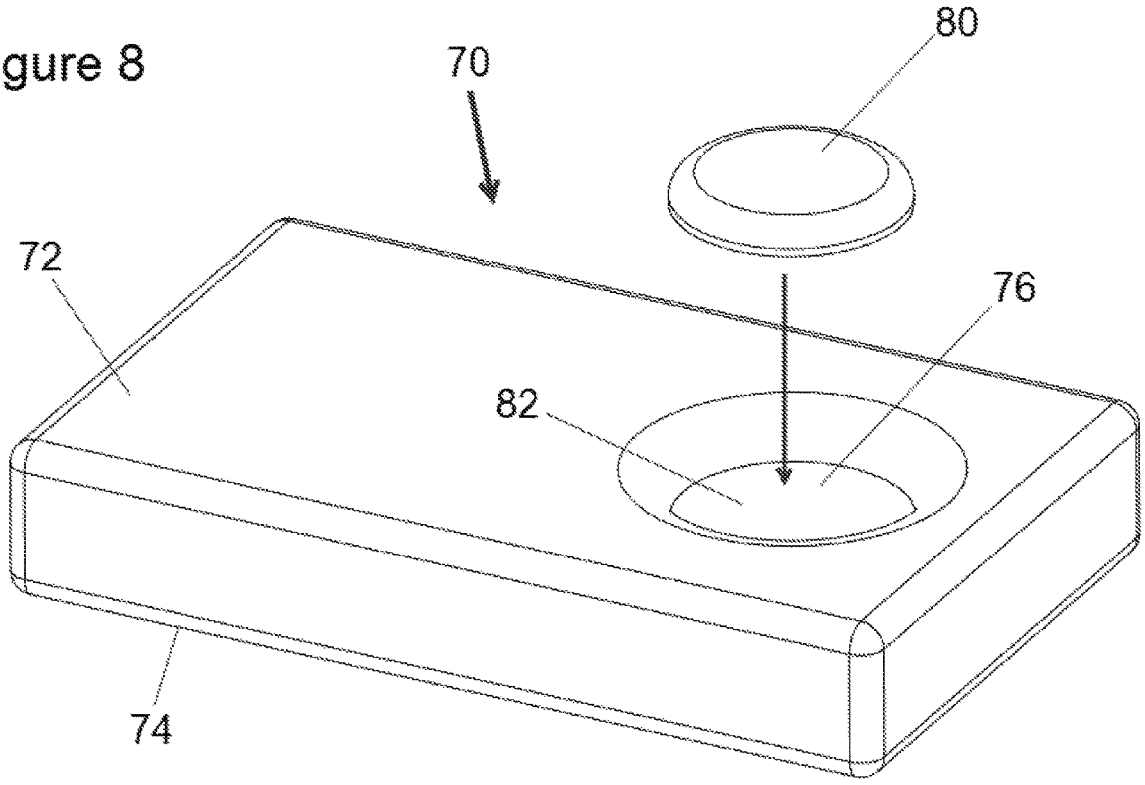
FIG. 8 is an upper perspective exploded view of a sponge, according to a third embodiment of the invention.
Figure 9:
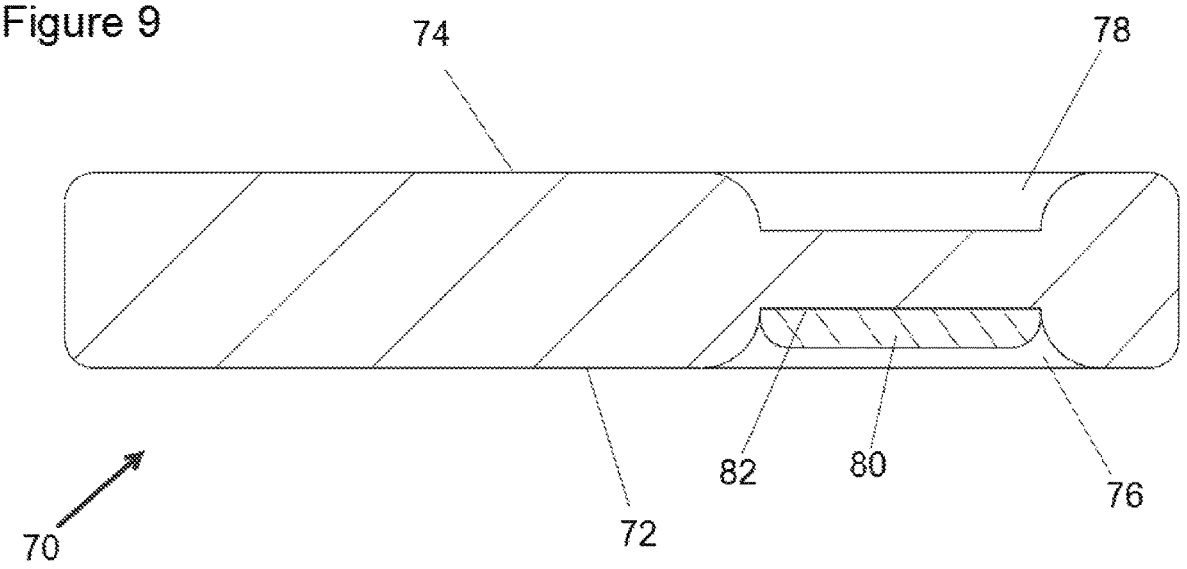
FIG. 9 is a cross-sectional view of the sponge of FIG. 8, according to the third embodiment of the invention, showing a abrasive pad located in a retracted position.
Figure 10:
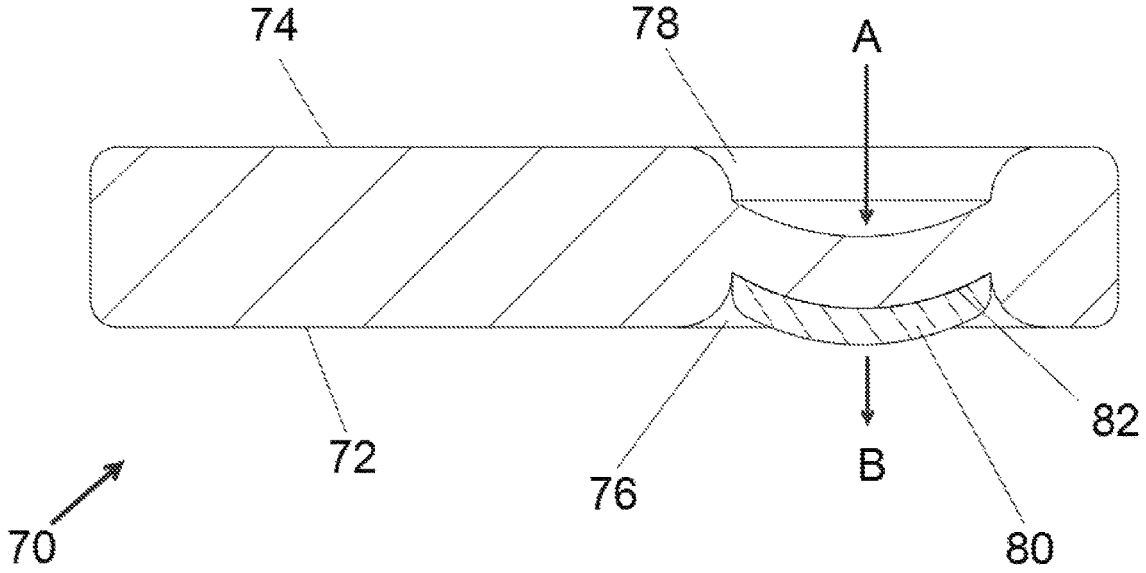
FIG. 10 is a cross-sectional view of the sponge of FIG. 8, according to the third embodiment of the invention, showing a abrasive pad located in an extended position.

Referring now to FIGS. 8, 9, and 10, a third embodiment of the invention is shown, which is similar to the above-described first embodiment shown in FIGS. 1-4, except that the recess is formed differently in this third embodiment, as described below.

According to this third embodiment, a sponge 70 includes a first surface 72 and an opposing second surface 74. A first recess 76 is formed into first surface 72 of sponge 70 to a first depth. A second recess 78 is formed into second surface 74 of sponge 70 to a second depth. First recess 76 may be any shape, but is preferably circular. Second recess 78 may be any shape, but is preferably circular and sized similar to the size of first recess 76. First and second depths are preferably substantially equal. First and second recesses 76, 78 are preferably formed simultaneously into their respective first and second surfaces using any appropriate embossing, molding, or milling processes. A supplemental abrasive pad 80 is bonded to a floor surface 82 of first recess, as shown in FIG. 8. The thickness of supplemental abrasive pad 82 is less than first depth of first recess 76.

In use of this third embodiment, sponge 70 functions identically to scrub-sponge 10 described above and shown in FIGS. 1-4, except that in this embodiment, the user activates supplemental abrasive pad 82 by pressing his or her finger(s) into second recess 78, which will in turn, force supplemental abrasive pad 58 to push from a retracted position, shown in FIG. 9, to an extended position, shown in FIG. 10, wherein supplemental abrasive pad 82 extends below first surface 72 of sponge 70 and into engagement with the surfaces being cleaned. When the user releases the downward pressure, supplemental abrasive pad 82 returns on its own to the retracted position, shown in FIG. 9, owing to the natural resiliency of the material making up sponge 70. If recesses 76, 78 are formed by embossing, then the sponge material located between the recesses will be compressed and more rigid. The increased rigidity in this area will help the user control supplemental abrasive pad 82 during scrubbing.

Figure 11:
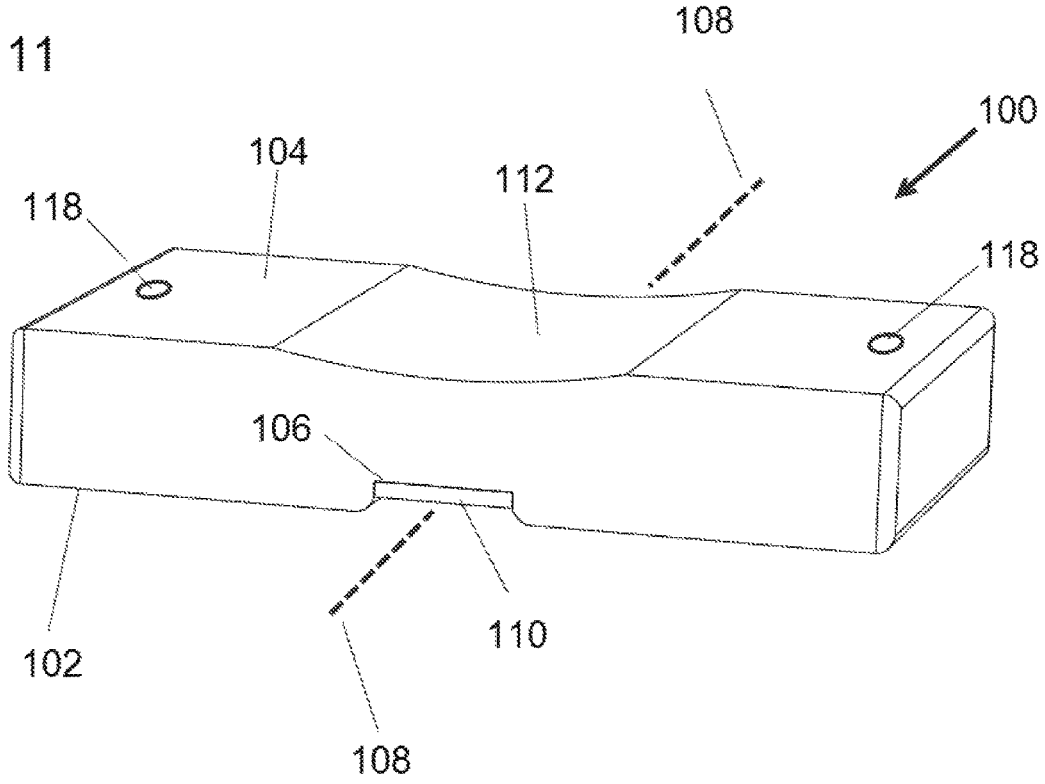
FIG. 11 is an upper perspective view of a flat scrub sponge, according to a fourth embodiment of the invention, showing the sponge in a flat orientation and having an abrasive insert positioned laterally across the sponge and in a recessed position.
Figure 12:
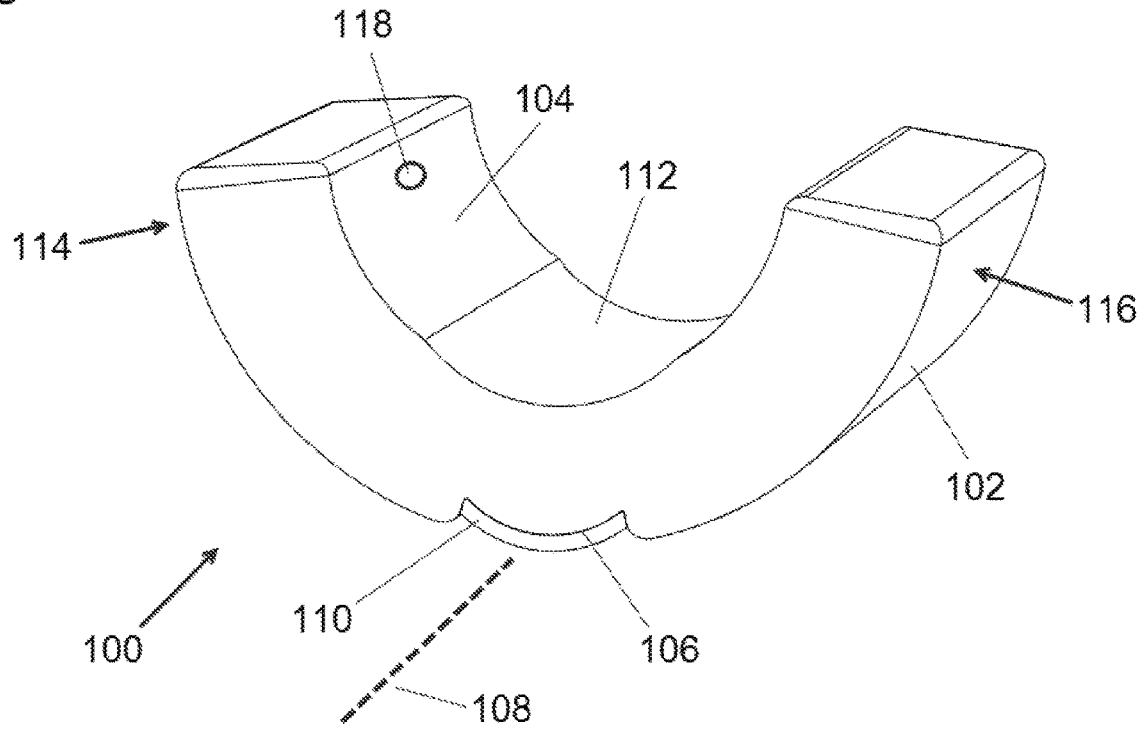
FIG. 12 is an upper perspective view of the scrub sponge of FIG. 11, according to the fourth embodiment of the invention, showing the sponge in a curved, bent orientation and wherein the abrasive insert is now deformed into a extended and accessible positioned laterally across the sponge and in a recessed position.

Referring now to FIGS. 11 and 12, a fourth embodiment of the invention is shown, including a sponge 100 which is shown generally rectangular in shape (but may be any shape) and defines a first surface 102 and a second surface 104. A laterally-disposed groove 106 is formed within sponge 100 across the mid-axis 108 or second surface 104, as shown in FIG. 11. Located within groove 106 is a supplemental abrasive pad 110, which, as in earlier embodiments described above, provides a more aggressive abrasive texture than sponge 100. Also as before, the thickness of abrasive pad 110 is less than the depth of groove 106 so that pad 110 will not contact the surfaces to be cleaned during normal sponge use. Located opposite groove 106 and located on first surface 102 of sponge 100 is a laterally formed depression 112, which is preferably curved in shape, as shown in FIG. 11. The purpose of depression 112 is to provide controlled flexibility to sponge 100, by encouraging it to bend about mid-axis 108, when a user folds the sponge during use, as explained below.

In use of this fourth embodiment of sponge 100, a user cleaning dishes, pots, pans and the like would use the present sponge as they would any other dish-washing sponge, with applied soap and water. The user would use sponge 100 in its flat orientation, as shown in FIG. 11, when a smooth, light cleaning action is required. If the user requires additional or stronger scrubbing action, he or she would press down against depression 112 of first surface 102 and fold the opposing ends of sponge 100 upward, as shown in FIG. 12 and as illustrated by the direction of arrows 114 and 116. As sponge 100 is folded, abrasive pad 110 deforms and bulges out of groove 106 and into physical contact with the surfaces being cleaned. The user could then use the more abrasive pad 110 to clean tough areas of the pots, dishes or pans, as needed. When the user released the sponge 100, the sponge returns to the flat orientation, as shown in FIG. 11 owing to the natural resiliency of the sponge material. Abrasive pad 110 will also return to its retracted position within groove 106, as before.

Figure 13:
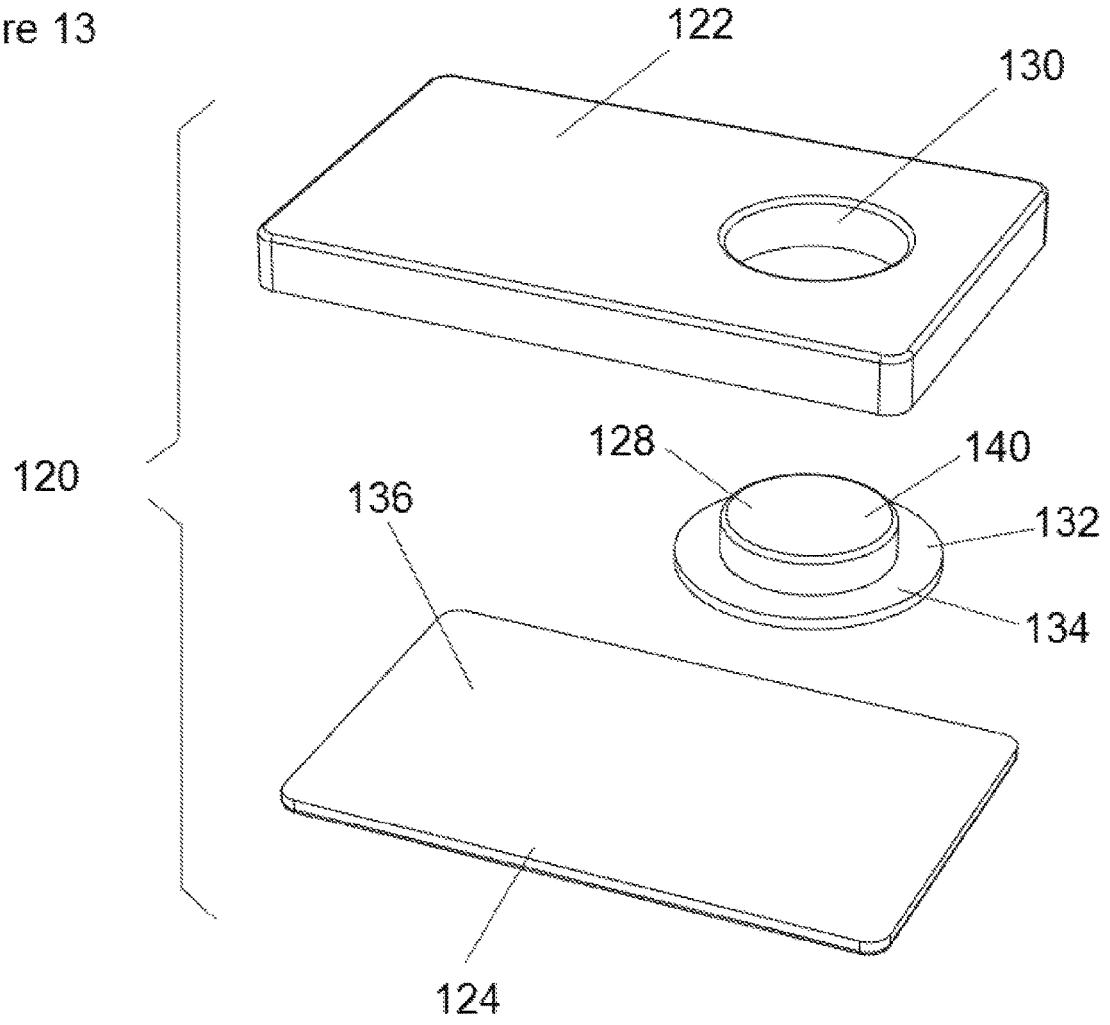
FIG. 13 is an upper perspective assembly view of a scrub sponge, according to a fifth embodiment of the invention, showing a sponge portion, an abrasive portion and a second abrasive element supported on a flexible membrane, positioned therebetween.

According to a fifth embodiment of the invention and referring to FIG. 13, a scrub sponge 120 is shown including a sponge portion 122 and a first abrasive portion 124 having a first level of abrasive texture. First abrasive portion 124 preferably has a shape that is similar to sponge portion 122 and is bonded to one surface 126 of sponge portion 122.

Similar to the above-described embodiments, scrub-sponge 120 includes a supplemental abrasive pad 128, which is positioned within a cutout 130 formed within sponge portion 122, as shown in the figure. Supplemental abrasive pad 128 is shaped similar to the shape of cutout 130 and may slide therein, when pushed by the fingers of a user, as described below.

Figure 14:
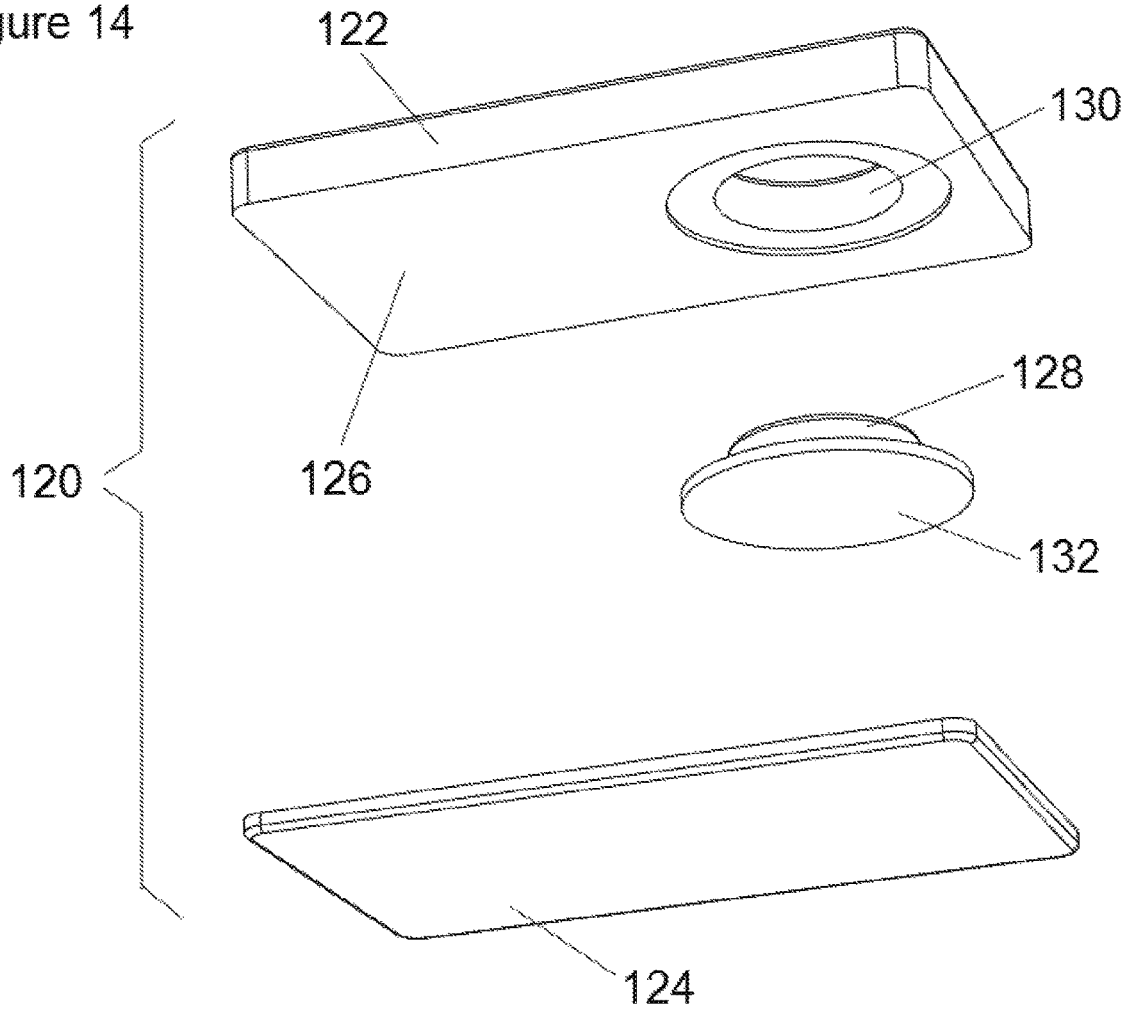
FIG. 14 is a lower perspective assembly view of a scrub sponge of FIG. 13, according to the fifth embodiment of the invention.
Figure 15:
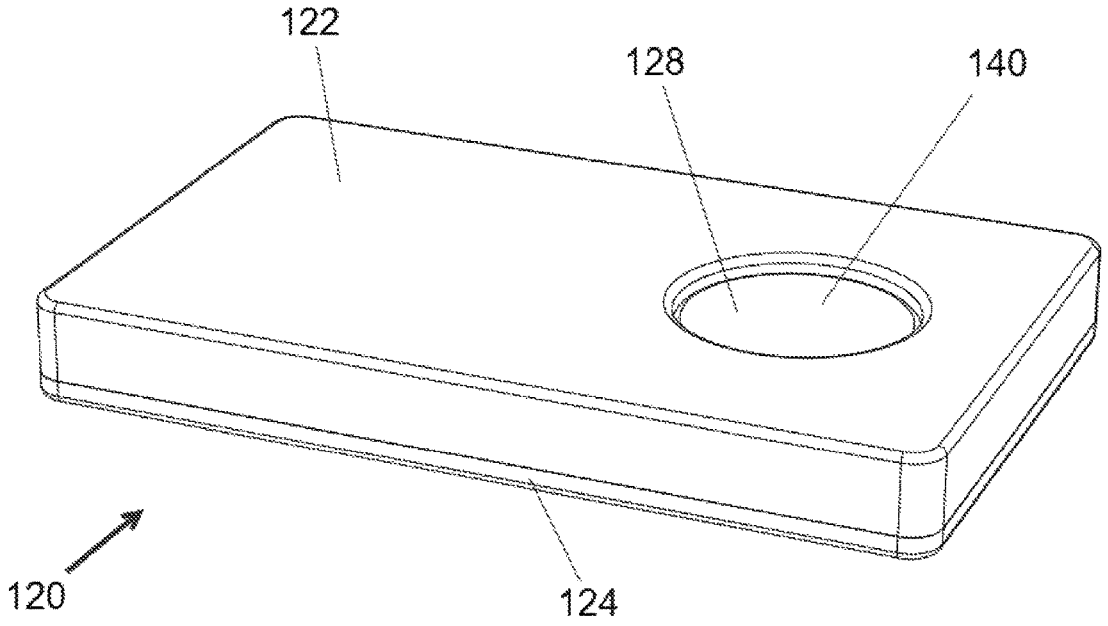
FIG. 15 is an upper perspective view of the assembled scrub sponge of FIG. 13, according to the fifth embodiment of the invention.

According to this embodiment, and shown in FIGS. 14 and 15, supplemental abrasive pad 128 is secured to a flexible membrane 132, which is shown circular in shape, but may be any appropriate shape. Flexible membrane is preferably made from a silicone rubber and is formed larger than cutout 130, defining a flange portion 134. During assembly, supplemental abrasive pad 128 is first bonded to the center of membrane 132 using an appropriate adhesive or bonding technique. Once bonded to the membrane, supplemental abrasive pad 128 is positioned within cutout 130 so that flange portion 134 abuts against surface 126. Flange portion 134 is preferably bonded to surface 126 of sponge 122, but may alternatively be bonded to surface 136 of first abrasive portion 124, or both surfaces. Finally, surface 136 of abrasive portion 124 is then bonded to surface 126 of sponge portion 122. Abrasive portion 124 preferably does not include any cutout so that when it is bonded to surface 126 of sponge portion 122, flange portion 134 of flexible membrane 132 becomes effectively secured between sponge portion and abrasive portion, thereby holding supplemental abrasive pad 128 in place within cutout 130. The height of supplemental abrasive pad 128 is less than the thickness of sponge portion 122 so that at rest and before deployment of the supplemental abrasive pad 128 is desired by the user, as described below, supplemental abrasive pad 128 resides within cutout 130 of sponge portion 122 and no portion of supplemental abrasive pad 128 will contact the surface being cleaned. When a user requires greater abrasive cleaning action, he or she uses their fingers to depress an accessible surface 140 of first abrasive portion 124 at a location that is aligned with and opposite cutout 130 of sponge portion 122. By pressing down here, the user's fingers will cause first abrasive portion to deform and flex flexible membrane 132, which in turn, will force supplemental abrasive pad 128 to advance from within cutout 130 sufficiently that its abrasive textured surface will contact the surface being cleaned. When the user no longer requires such aggressive abrasive texture, he or she simply relaxes the fingers so that the spring-biased resiliency of flexible membrane 132 returns to its rest position, and by doing so forces supplemental abrasive pad 128 to retract to its recessed and inaccessible position located within cutout 130 of sponge portion 122.

In this fifth embodiment, and in the others described above, supplemental abrasive pad 128 may have a level of abrasive texture which is equal to or different from first abrasive portion 124, or equal to or different from the level of abrasive texture of sponge portion 122. Applicant's contemplate that supplemental abrasive pad 128 provides a stronger abrasive texture than that of first abrasive portion 124 and that first abrasive portion 124 provides a stronger abrasive texture than that of sponge portion 122. Supplemental abrasive pad 128 may be made from an abrasive or cleaning material that is new to the market, or is not selling well so that customers of the scrub brush 120 may sample the new cleaning material simply by pressing the right spot, but if they don't like the new material, the user may still use the scrub sponge 120, as before. If the customer likes the new cleaning material, he or she will more likely purchase other products from the company which include the same cleaning material. Therefore, the supplemental abrasive pad 128 may be used as a marketing tool to get customers to try out a new sample or product.

Conventional Manufacture of Cellulose Sponges:

One process for making a cellulose type sponge includes the following steps:

1. Cellulose is typically provided in large stiff sheets. The sheets are soaked in a vat of water mixed with certain chemical softeners causing the stiff cellulose fibers to become soft and jelly-like. Sodium sulphate crystals, cut hemp fibers, and dye, are added and the ingredients are thoroughly mixed.

2. The mixture is then poured into a large mold and heated, causing the sodium sulphate crystals to melt and drain away, leaving voids throughout the material—the voids are similar to those found in natural sponges. The cellulose mixture hardens in the mold.
3. The block is then removed and cleaned with bleach and water.
4. The block is then cut into individual sponges to be packaged and sold.

Once cut to shape, the conventional sponge may be further processed, according to the above invention, to include the selectively deployed abrasive element, depending on the particular embodiment, as described above. This includes cutting, stamping, embossing, and bonding, all techniques that are generally understood by those skilled in the art.

What is claimed is:

1. A scrub sponge for selectively cleaning a working surface by a user, said sponge comprising:

a substrate made from a first flexible material and defining a top surface and an opposing bottom surface;

a recess formed within said bottom surface of said substrate, said recess having a first shape and a first depth and defining a recessed surface;

a layer of a second material located within said recess and secured to said recessed surface, said second material having a first level of abrasive texture, said layer having a magnitude of thickness that is less than the magnitude of said first depth of said recess so that said second material resides within said first substrate, with respect to said bottom surface of said substrate; and wherein said second material extends beyond said bottom surface of said substrate in response to selective deformation of said substrate by said user so that said second material with said first level of abrasive texture can be selectively accessed to clean said working surface by said user.

2. The scrub sponge, according to claim 1, wherein said first material includes a second level of abrasive texture and wherein said second level of abrasive texture is greater than said first level of abrasive texture.

3. The scrub sponge, according to claim 1, wherein said first material includes a second level of abrasive texture and wherein said first level of abrasive texture is greater than said second level of abrasive texture.

4. The scrub sponge, according to claim 1, wherein said layer of said second abrasive texture includes a support material which is bonded to said recess surface.

5. The scrub sponge, according to claim 4, wherein the shape of said support material is substantially similar to said first shape of said recess.

6. The scrub sponge, according to claim 1, wherein said first shape of said recess is generally circular.

7. The scrub sponge, according to claim 1, wherein said first shape of said recess is generally rectangular.

* * * * *